US009525953B2

(12) United States Patent
Storms, Sr.

(10) Patent No.: US 9,525,953 B2
(45) Date of Patent: Dec. 20, 2016

(54) METHOD AND APPARATUS FOR TRANSIT SYSTEM ANNUNCIATORS

(71) Applicant: Russell Louis Storms, Sr., Rockville, MD (US)

(72) Inventor: Russell Louis Storms, Sr., Rockville, MD (US)

(73) Assignee: Russell Louis Storms, Sr., Olney, MD (US)

( * ) Notice: Subject to any disclaimer, the term of this patent is extended or adjusted under 35 U.S.C. 154(b) by 224 days.

(21) Appl. No.: 14/044,873

(22) Filed: Oct. 3, 2013

(65) Prior Publication Data

US 2015/0098585 A1 Apr. 9, 2015

(51) Int. Cl.
*H04R 27/00* (2006.01)
*H04R 29/00* (2006.01)
*G10L 21/0364* (2013.01)

(52) U.S. Cl.
CPC ..... *H04R 27/00* (2013.01); *G10L 21/0364* (2013.01); *H04R 29/007* (2013.01); *H04R 2227/007* (2013.01); *H04R 2227/009* (2013.01); *H04R 2499/13* (2013.01)

(58) Field of Classification Search
CPC . H04R 2227/009; H04R 27/00; H04R 29/007; H04R 2227/00; H04R 2499/13
USPC ..... 381/2, 200, 302, 82, 86
See application file for complete search history.

(56) References Cited

U.S. PATENT DOCUMENTS 3,720,788 A * 3/1973 Hashimoto ..... H04R 27/00 381/80
5,889,867 A * 3/1999 Bauck ..... H04S 3/02 381/1
6,407,673 B1 * 6/2002 Lane ..... G08B 17/10 340/628
2002/0019696 A1 * 2/2002 Kruse ..... G01C 21/26 701/408
2002/0186328 A1 * 12/2002 Nishida ..... H04N 5/607 348/738
2003/0031327 A1 * 2/2003 Bakis ..... H04R 3/00 381/77
2005/0207590 A1 * 9/2005 Niehoff ..... G10K 15/02 381/77

(Continued)

OTHER PUBLICATIONS

WO 2013/168254 A1 filed May 10, 2012 (English Translation Provided).*

*Primary Examiner* — Thomas Alunkal

(57) ABSTRACT

An apparatus and method for spatialized communication of announcements to persons in a transit vehicle moving among a plurality of transit stations in at least two different languages simultaneously, in which at least two sound-emittive speakers are spaced-apart and disposed in opposing relation for persons to hear announcements. A storage device stores signals representative of at least one announcement associated with at least each transit station in at least two different languages. A communicator simultaneously communicates the signals representative of the announcement for each one of the at least two languages to a respective one of the speakers at a predetermined time prior to arrival of the transit vehicle at the transit station in sequence. The announcement, being communicated by each one of the at least two speakers in one of the at least two languages, is spatializedly discernable by persons in the transit vehicle in each of the communicated language.

28 Claims, 2 Drawing Sheets

(56) References Cited

U.S. PATENT DOCUMENTS

| | | | | |
|---|---|---|---|---|
| 2006/0116075 | A1* | 6/2006 | Gallo | H04L 12/189 455/41.2 |
| 2007/0136050 | A1* | 6/2007 | Tourwe | H03G 5/005 704/205 |
| 2008/0232612 | A1* | 9/2008 | Tourwe | H03G 9/005 381/99 |
| 2010/0162326 | A1* | 6/2010 | Bonar | H04N 7/18 725/77 |
| 2013/0138422 | A1* | 5/2013 | Daye | G10L 15/005 704/8 |
| 2013/0322855 | A1* | 12/2013 | Huang | H04N 21/440236 386/248 |

* cited by examiner

METHOD AND APPARATUS FOR TRANSIT SYSTEM ANNUNCIATORS

TECHNICAL FIELD

The present invention relates to annunciators used in transit systems for broadcasting announcements to passengers. More particularly, the present invention relates to annunciators simultaneously broadcasting messages to passengers using transit vehicles of a transit system.

BACKGROUND OF THE INVENTION

Persons traveling on transit vehicles in mass transit systems such as air or ground vehicle transportation systems pass through transit stations. Broadly, these transit stations provide central locations for the transit vehicles to embark and disembark passengers as the persons travel from an originating station to a destination station as well as passing through intermediate transit stations for the person to transfer from one transit vehicle to another on the trip. Announcement devices are used at the transit stations and in the transit vehicles for guiding the persons to appropriate gates for traveling on the appropriate transit vehicle. These announcement devices include travel message boards, video displays, and audio announcements broadcast in terminals and transit vehicles over loudspeakers. Multiple language announcements typically are presented serially on display boards, aurally, or in combination. Generally, there is a time restriction on announcements due to the number of announcements that must be made. Further, the number of different languages restricts the time available for any one particular announcement. The shorter the amount of available time, the fewer the number of languages or the shorter the message in the announcement. Also, passengers may not be aware of display messages, by not being in the vicinity of the display or being blocked from viewing the display.

Many large commercial airport transit stations use high capacity moveable vehicles to carry passengers among the several concourses having gates to which the passengers move for boarding aircraft. These movable vehicles have a variety of forms, including trains of interconnected cars, buses, and the like. Typically, these vehicles have open interiors with minimal seating. This increases the capacity of the vehicles without significant inconvenience to the passengers who stand as the vehicle travels a predetermined route from concourse to concourse. Generally, the concourses have unique identifiers, so that the passengers can locate the particular aircraft for the planned travel. The vehicles have devices onboard for advising the passengers of the transit stop for the concourse at which the vehicle is arriving. Often the concourses are close together. With the increasing number of international and foreign travelers, announcements of transit stops often are made in different languages. In typical transit stations serving international travelers, announcements are made in English, Spanish, French, and Japanese. While the announcements are typically of short duration because limited information is to be communicated, specific language requirements dictate that the announcement in one language is of longer duration than in other languages. Depending on the interval between transit stations, an announcement may not provide sufficient time for passengers hearing the message in their language to react and depart from the vehicle. The announcement may be rushed or shortened, and thereby not communicate effectively with the passengers. Communication of aural messages involves a listener's capability to localize and discriminate auditory events, to distinguish the effect of when and where auditory events including initial sounds and subsequent echoes, and to focus on one of many auditory events occurring simultaneously. The ability to localize auditory events separated in three-dimensional space enables listeners to discriminate the auditory events. The Duplex theory suggests that listeners experience both interaural time differences, or time delays when sounds reach one ear before the other, and interaural intensity differences, or intensity differences in sounds reaching the ears as a result of head orientation. Further, the shapes of the outer ears (the pinea) also affect sound localization whereby the listener determines the location of the source of the sound. Localization is also dependent upon physical characteristics such as shoulder echo, head motion, early echo response, reverberation, atmospheric absorption, bone conduction, and prior knowledge by a listener of the sound source. The precedence effect relates to when and where auditory events are first perceived. This influences the listener's belief as to the direction of origination of the sounds. Precedence helps listeners distinguish between original sounds and subsequent echoes or reverberation. Further, listeners generally have an ability to detect, discriminate, and focus on one selected voice communicating sounds among many such voices. This ability may be described as the cocktail party effect, whereby a listener focuses on one of many voices. Factors affecting the ability to filter unwanted speech or noise and thus aid in focusing on a single voice include spatial separation, modulation of speech or sounds, and visual cues. For example, studies have shown that listeners could more readily focus on a desired voice among many when loudspeakers were disposed at 90° azimuth relative to the listener. Other discrimination effects are noted with low- and high-filtering, such as at 1.6 kHz. U.S. Pat. No. 5,438,623 describes a device that spatilizes messages communicated to listeners wearing headphones to four virtual auditory positions, so that the listeners can more easily focus on one of the four simultaneously presented voice channels. However, such is impractical for open-field environments and requires processing of monophonic sounds in real-time with digital signal processors to create spatially separate virtual sounds. Accordingly, there is a need in the art for an improved apparatus and method of communicating messages to persons using transit systems. It is to such that the present invention is directed.

BRIEF SUMMARY OF THE INVENTION

The present invention meets the need in the art by providing an apparatus for spatialized communication of announcements within a transit vehicle to persons in at least two different languages simultaneously, comprising at least two sound-emittive speakers spaced-apart within a transit vehicle for transporting persons and disposed in opposing relation for communicating stored signals that are representative of at least one announcement in at least two different languages. The apparatus simultaneously communicates the signals representative of the announcement for each one of the at least two languages to a respective one of the speakers, whereby the announcement, being communicated by each one of the at least two speakers in one of the at least two languages, is spatializedly discernable in each of the communicated languages.

In another aspect of the present invention, the apparatus further comprises a modulator for modifying the announcements to further distinguish the announcement in the languages from one another. The apparatus comprises low-pass and high-pass filters to modify selectively the tone of the announcements. The apparatus comprises means to make the announcements in a first gender voice and a second gender voice selectively to further distinguish the announcement in the languages from one another.

In another aspect, the present invention provides a method of spatialized communication of announcements in different languages simultaneously to persons moving in a transit vehicle among a plurality of transit stations, comprising the steps of:

(a) providing a plurality of speakers spaced-apart and disposed in facing opposing relation in a transit vehicle moving persons among a plurality of transit stations;

(b) placing in a storage device signals representative of at least one announcement in a plurality of languages differing from each other;

(c) communicating simultaneously the signals representative of the at least one announcement in each one of the languages to the speakers at a predetermined time prior to arrival of the transit vehicle at one of the transit stations, the communicated announcement associated with the respective transit station;

whereby the announcement, being communicated by the speakers with each speaker communicating one of the languages, is spatializedly discernable in each of the communicated languages.

In another aspect of the present invention, the method further comprises the step of modulating the announcement in at least one of the languages to further distinguish the announcement from the announcement in the other of the languages. The method comprises filtering the announcement selectively with a low-pass filter and a high-pass filter to modify the tone of the announcements. The method comprises making the announcements selectively in a first gender voice and a second gender voice to further distinguish the announcement in the languages from one another.

Objects, advantages and features of the present invention will become apparent from a reading of the following detailed description of the invention and claims in view of the appended drawings.

DETAILED DESCRIPTION OF THE PREFERRED EMBODIMENTS

Figure 1:
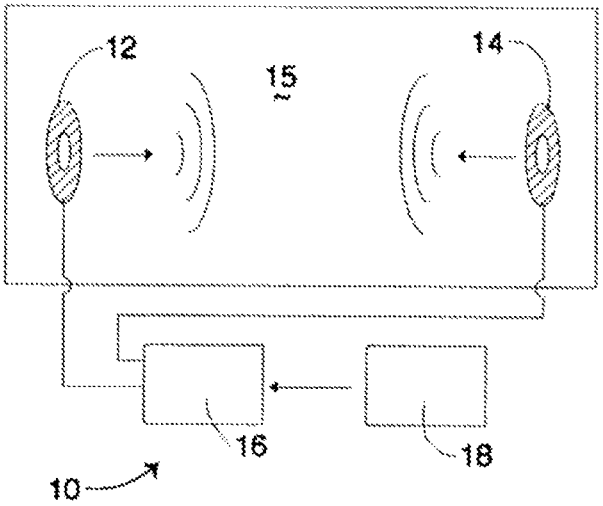
FIG. 1 illustrates a schematic diagram of a transit vehicle having an annunciator apparatus according to the present invention.

Referring now in more detail to the drawings in which like parts have like identifiers, FIG. 1 illustrates a schematic diagram of a transit vehicle having an annunciator apparatus 10 according to the present invention. The annunciator apparatus 10 comprises at least two speakers 12, 14 disposed in a space 15 such as a transit vehicle or transit station waiting area. The speakers 12, 14 are disposed in opposing relation and operatively connected to a memory device 16 that contains at least one message for communicating by the speakers 12, 14. The memory device 16 according to the present invention contains the message in at least two languages. The memory device 16 includes conventional recording capability, whereby one or more messages in different languages are recorded. For example, the memory device 16 can be a digital recorder or more simply a tape recorder apparatus associated with each of the speakers 12, 14. The memory device 16 connects to a controller 18. The controller 18 includes switches for selectively communicating the recorded message in one language to a respective one of the speakers 12, 14 and communicating the message in another of the languages to the other of the speakers 14, 12. The controller 18 uses conventional signals for initiating the communication of the message by the speakers 12, 14. For example, the signal may be clock-based whereby the message is communicated at a particular time. In transit systems, a switch in a track for the transit vehicle triggers the controller to initiate the communication of the message. Conventional signaling apparatus is readily used, whereby a particular message in a sequence of messages is communicated. Thus, the memory device 16 for a transit system having a plurality of stops has a separate message for each of the stops with the message in at least two different languages. Prior to each stop, the appropriate message in the at least two different languages is communicated from the speakers 12, 14 simultaneously.

Figure 2:
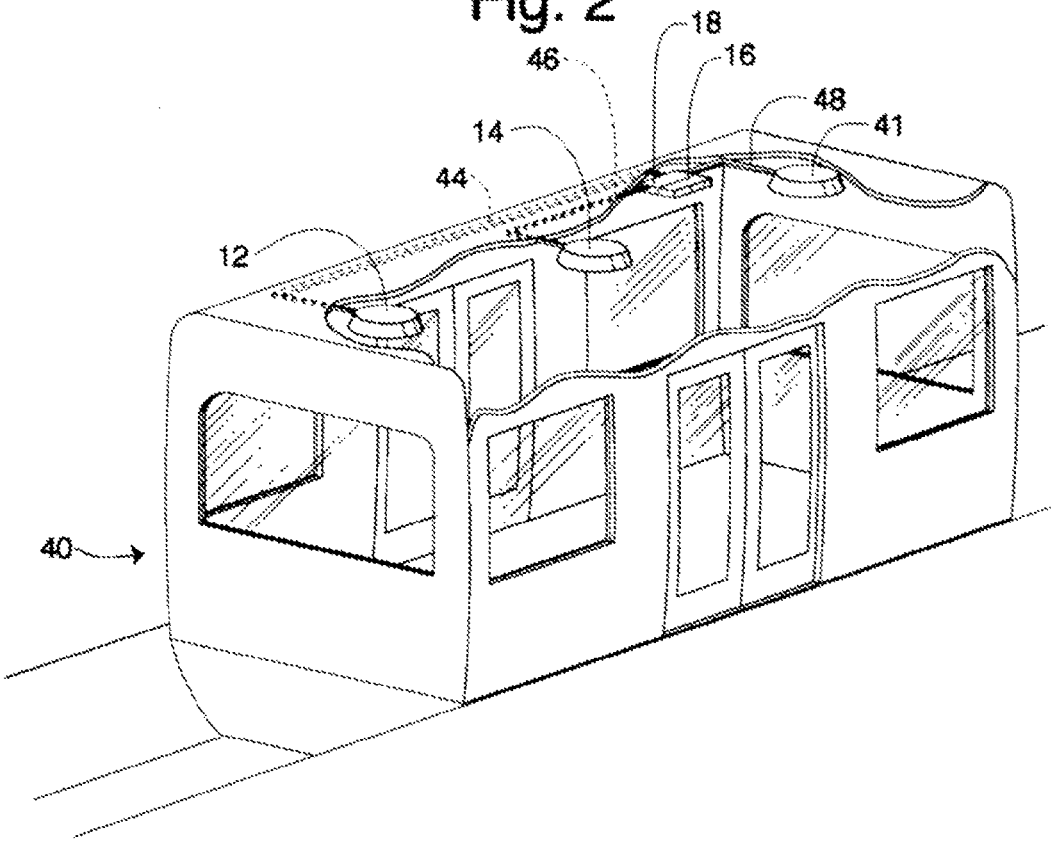
FIG. 2 illustrates a cut-away perspective view of a transit vehicle having a second embodiment of the annunciator apparatus of the present invention.

FIG. 2 illustrates a cut-away perspective view of a transit vehicle 40 having an alternate embodiment of the annunciator apparatus 10 of the present invention, in which three speakers 12, 14, 41 are provided in the ceiling of a transit vehicle 40. Electrical signal wires 44, 46, and 48 connect between the memory device 16 that is operated by the controller 18 (illustrated as mounted in the ceiling of the transit vehicle).

Figure 3:
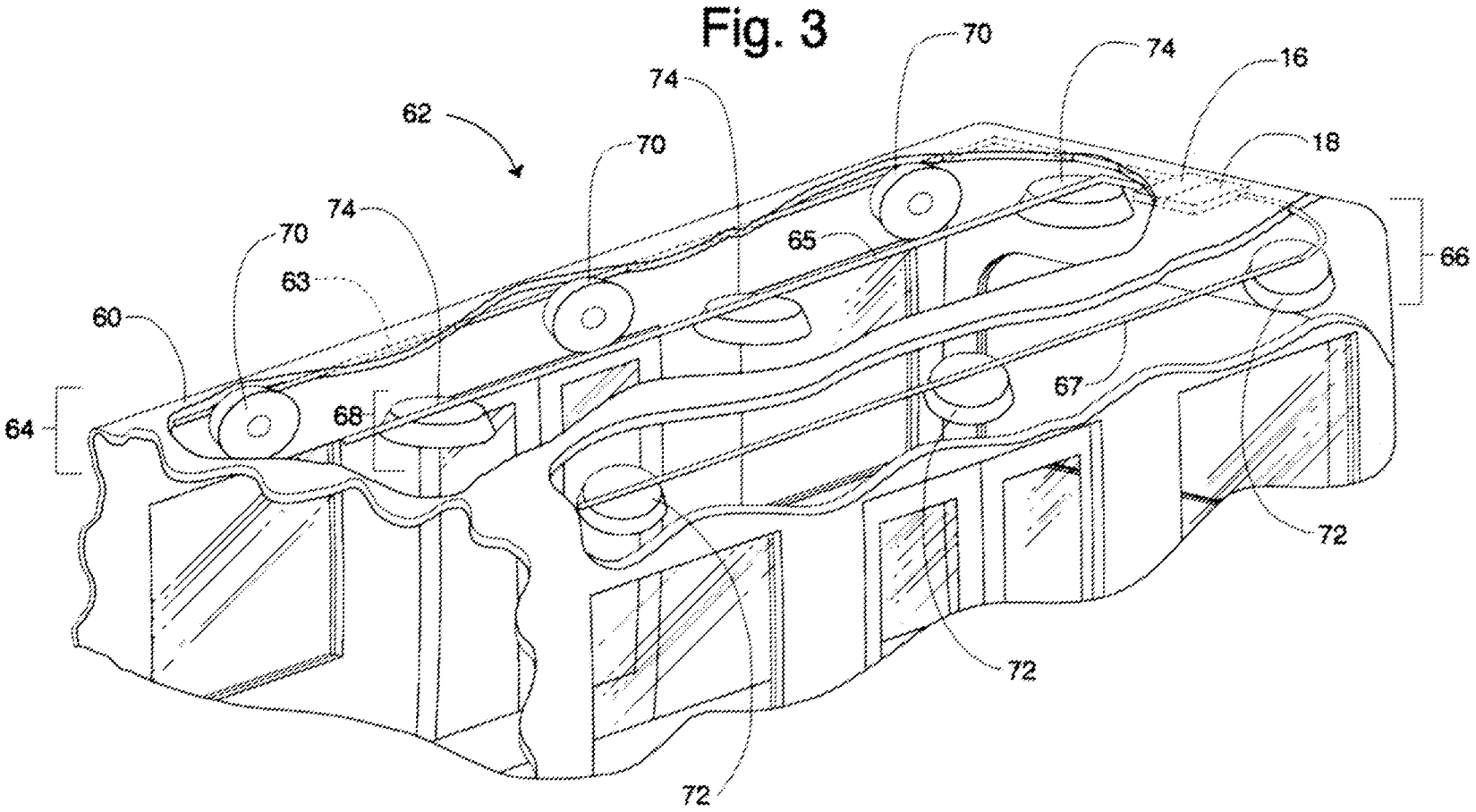
FIG. 3 illustrates a cut-away perspective view of an upper portion of a transit vehicle having a third embodiment of the annunciator apparatus of the present invention.

FIG. 3 illustrates a cut-away perspective view of an upper portion of a transit vehicle 60 having an alternate embodiment of the annunciator apparatus 62 of the present invention. The annunciator apparatus 62 includes the memory device 16 that is operated by the controller 18. In the illustrated embodiment, the memory device 16 and the controller 18 are mounted in the ceiling. In an alternate embodiment these are mounted within an enclosure with other vehicle operational equipment in the transit vehicle or in another transit vehicle connected to the illustrated transit vehicle. The annunciator apparatus 62 has three sets 64, 66, and 68 of a plurality of speakers 70, 72, and 74. The speakers are preferably disposed with the set 64 of speakers 70 on an upper portion of one side wall, the set 66 of speakers 72 on the opposing side wall, and the set 68 of speakers 74 on the ceiling. The speakers 70, 72, and 74 in each of the sets 64, 66, and 68 are connected with electrical signal members 63, 65, and 67, respectively, in parallel. These electrical signal members 63, 65, and 67 comprise multi wire lines connected to the memory device 16. Each set 64, 66, and 68 connects to the memory device 16 for receiving electrical signals representative of the message in a particular language. In a multi-vehicle train, each of the sets 64, 66, and 68 are interlinked between adjacent vehicles.

With reference to FIG. 1, the annunciator apparatus 10 is operated to provide at least one message to a plurality of persons in the space 15, for example, in a transit vehicle or a transit station waiting area, in at least two different languages simultaneously. The embodiment illustrated in FIG. 1 provides an area separation configuration. The operating speakers 12, 14 emit sound into the space 15. The persons hear both messages in the two different languages. However, the ability of persons to localize sound, to respond to precedence effects and to focus listening attention, allows the persons to better comprehend the sounds in the language the person understands with the message in the second language becoming part of the background or ambient noise in the space 15.

Generally, area separation speaker configurations are limited by transit vehicle dimensions and the acoustics of the transit vehicle. As the distance increases among the speakers 12, 14, the intensity or volume of the sound generated by the speakers must increase to ensure that persons remote from the speaker hear the sounds from the speakers. A point is eventually reached however, depending on acoustic and dimensional factors when the intensity of the sound from one speaker saturates and attenuates the sound from the other speaker at the remote positions in the space 15. Acoustic factors include the materials used in the interior of the space (sound absorbent or reflective), whether the persons are standing or sitting, ambient noises such as moving friction of wheels and roadway or track, motor or engine noise, and the like. Absorbent obstructions to the sound result in faster saturation of the sounds. Generally, in applications in which the length of the space 15 exceeds the width by about a factor of 5 or more, persons find it increasingly difficult to hear the sounds from the remote speaker.

FIG. 2 illustrates area separation with three speakers 12, 14, and 41 with communication of messages in three different languages. Based on demographics of persons using the space 15 or the transit vehicle 40, various combinations of languages can be provided. Although the apparatus 10 places one of the foreign languages predominately in a portion of the space 15 local to the particular speaker 12, 14, and 41, the ability to localize, discriminate, respond to precedence, and to focus listening, permits the apparatus 10 to present multiple languages in parallel simultaneously to international passengers using the space 15 or the transit vehicle 40.

FIG. 3 illustrates lengthwise separation of speakers and sounds in the transit vehicle 60. This embodiment overcomes the limitations of area sound saturation discussed above. The embodiment illustrated in FIG. 3 provides three-language spatial separation of sounds from the speakers 70, 72, and 74. In an alternate embodiment, a fourth set of speakers are disposed on the ceiling spaced-apart from the set 68, whereby messages in four languages are communicated into the space of the transit vehicle 60. The ability of persons to localize, to discriminate sounds, to respond to precedence, and to focus listening, permits the apparatus 10 to present multiple languages in parallel simultaneously to international passengers using the transit vehicle 60. The controller 18 receives a signal for communicating one of the messages in the memory device 16. The controller 18 directs the memory device 16 to communicate the selected message in the selected languages to the respective speakers 70, 72, and 74, whereby the persons hear the message in a language comprehended by the persons, with the other languages becoming part of the ambient noise.

Further discrimination of the messages in the differing languages is provided in accordance with the present invention by filtering the tone of the sounds from a selected speaker or by providing gender-varied message signals. With respect to FIG. 1, tonal separation is provided by having the message in the first language low-pass filtered prior to the communication by the speaker 12 and having the message in the second language high-pass filtered prior to the communication by the speaker 14. It is contemplated that a filter point of about 1.6 kHz provides adequate separation; a particular filter point is affected by the particular acoustics of the space 15 or the transit vehicle 40, 60 and the original spectral dynamics of the speech signal being filtered. Further, gender separation is achieved by having the message in one of the languages presented with a male voice while another of the languages is presented with a female voice.

According to the present invention, further discrimination is achieved by providing combined tonal and gender separation. For example, the message in one language is low-pass filtered and presented with a male voice; a second language is high-pass filtered and presented with a male voice; a third language is low-pass filtered and presented with a female voice; and a fourth language is high-pass filtered and presented with a female voice. Combinations of the filters, filtering points, and gender variations enable maximizing the sound separation within particular transit vehicles 40, 60 and spaces 15 while facilitating the person's understanding of the message in his particular language with the other languages becoming to that person merely part of the ambient noise.

It is thus seen that an apparatus for communicating announcements to passengers using transit vehicles of a transit system is provided, together with a method of simultaneously communicating announcements in differing languages to passengers. While this invention has been described in detail with particular reference to the preferred embodiments thereof, the principles and modes of operation of the present invention have been described in the foregoing specification. The invention is not to be construed as limited to the particular forms disclosed because these are regarded as illustrative rather than restrictive. Moreover, modifications, variations and changes may be made by those skilled in the art without departure from the spirit and scope of the invention as described by the following claims.

What is claimed is:

1. An apparatus for open-field acoustic spatialized communication of announcements within a transit vehicle to persons in at least two different languages simultaneously, comprising: a transit vehicle for transporting persons; at least two non-parametric sound-emittive speakers spaced-apart and disposed in opposing relation on the interior ceiling and upper portion of the walls within the transit vehicle; means for storing signals representative of at least one announcement in at least two different languages; means for simultaneous communication of the signals representative of the announcement for each one of the at least two languages to a respective one of the speakers; wherein the announcement, being communicated by each one of the at least two speakers in one of the at least two languages, is spatializedly discernable by persons in each of the communicated languages, means for modulating the announcement in at least one of the languages to further distinguish the announcement from the announcement in the other languages, wherein means for modulating comprises a low-pass filter for the announcement in the one of the languages.

2. The apparatus as recited in claim 1, wherein means for modulating further comprises a high-pass filter for the announcement in at least one of the other of the languages, wherein the announcements are distinguished in language and in tonal features from each other.

3. The apparatus as recited in claim 1, wherein means for modulating comprises a first gender separation of the announcement in the one of the languages.

4. The apparatus as recited in claim 3, wherein means for modulating further comprises a second gender separation different from the first gender separation for the announcement in the other of the languages, wherein the announcements are distinguished in language and in tonal features from each other.

5. The apparatus as recited in claim 1, wherein means for modulating comprises filter means and gender separation means cooperatively modifying the announcement in the languages to distinguish the announcements from each other.

6. The apparatus as recited in claim 5, where filter means comprises a low-pass filter and a high-pass filter and gender separation means comprises a first gender voice and a second gender voice; and wherein one of the announcements in a first language is modified by the low-pass filter and the first gender voice and the announcement in the other of the languages is modified by the high-pass filter and the second gender voice.

7. The apparatus as recited in claim 6, wherein the announcement in a third language is modified by the low-pass filter and the second gender voice.

8. The apparatus as recited in claim 7, wherein the announcement in a fourth language is modified by the high-pass filter and the first gender voice.

9. The apparatus as recited in claim 1, wherein the two non-parametric speakers are ones of at least two sets of a plurality of speakers spaced-apart in opposing relation on the interior ceiling and upper portion of the walls in a transit vehicle.

10. An apparatus for open-field acoustic spatialized communication of announcements within a transit vehicle to persons in different languages simultaneously, comprising: a transit vehicle for transporting persons among a plurality of transit stations; a plurality of non-parametric speakers spaced-apart and disposed in facing opposing relation on the interior ceiling and upper portion of the walls within the transit vehicle; a storage device for storing signals representative of a plurality of announcements in a plurality of languages differing from each other; means for simultaneous communication of the signals representative of a selected one of the announcements for each one of the languages to at least one of the speakers; wherein the announcement, being communicated by the speakers with each speaker communicating one of the languages, is spatializedly discernable by persons in each of the communicated languages, means for modulating the announcement in at least one of the languages to further distinguish the announcement from the announcement in the other languages, wherein means for modulating comprises a low-pass filter for the announcement in the one of the languages.

11. The apparatus as recited in claim 10, wherein means for modulating further comprises a high-pass filter for the announcement in at least one of the other of the languages, wherein the announcements are distinguished in language and in tonal features from each other.

12. The apparatus as recited in claim 10, wherein means for modulating comprises a first gender separation of the announcement in the one of the languages.

13. The apparatus as recited in claim 12, wherein means for modulating further comprises a second gender separation different from the first gender separation for the announcement in the other of the languages, wherein the announcements are distinguished in language and in tonal features from each other.

14. The apparatus as recited in claim 10, wherein means for modulating comprises filter means and gender separation means cooperatively modifying the announcement in the languages to distinguish the announcements from each other.

15. The apparatus as recited in claim 14, where filter means comprises a low-pass filter and a high-pass filter and gender separation means comprises a first gender voice and a second gender voice; and wherein one of the announcements in a first language is modified by the low-pass filter and the first gender voice and the announcement in the other of the languages is modified by the high-pass filter and the second gender voice.

16. The apparatus as recited in claim 14, wherein the announcement in a third language is modified by the low-pass filter and the second gender voice.

17. The apparatus as recited in claim 16, wherein the announcement in a fourth language is modified by the high-pass filter and the first gender voice.

18. The apparatus as recited in claim 10, wherein the non-parametric speakers are ones of at least two sets of a plurality of speakers spaced-apart in opposing relation on the interior ceiling and upper portion of the walls in a transit vehicle.

19. A method of open-field acoustic spatialized communication of announcements in different languages simultaneously to persons moving in a transit vehicle among a plurality of transit stations, comprising: providing a plurality of non-parametric speakers spaced-apart and disposed in facing opposing relation on the interior ceiling and upper portion of the walls in a transit vehicle moving persons among a plurality of transit stations; placing in a storage device signals representative of at least one announcement for each of the plurality of transit stations in a plurality of languages differing from each other; communicating simultaneously the signals representative of the announcement in each one of the languages to at least one of the speakers at a predetermined time prior to arrival of the transit vehicle at one of the transit stations, the communicated announcement associated with the respective transit station; wherein the announcement, being communicated by the speakers with each speaker communicating one of the languages, is spatializedly discernable by persons in each of the communicated languages, the step of modulating the announcement in at least one of the languages to further distinguish the announcement from the announcement in the other of the languages, wherein the step of modulating comprises filtering the announcement in the one language with a low-pass filter.

20. The method as recited in claim 19, wherein the step of modulating further comprises filtering the announcement in the other of the languages with a high-pass filter, wherein the announcements are distinguished in language and in tonal features.

21. The method as recited in claim 19, wherein the step for modulating comprises creating the announcement in a first gender voice for the one of the languages.

22. The method as recited in claim 21, wherein the step for modulating further comprises creating the announcement in a second gender voice different from the first gender voice for the announcement in the other of the languages, wherein the announcements are distinguished in language and in tonal features from each other.

23. The method as recited in claim 19, wherein the step for modulating comprises the steps of filtering the announcement and making the announcement in a first gender voice in the one of the languages for cooperatively distinguishing the announcements from each other.

24. The method as recited in claim 23, where the step of filtering comprises selectively filtering the announcement in the languages with a low-pass filter and a high-pass filter and the step of making the announcement in the languages selectively uses a first gender first gender voice and a second gender voice.

25. The method as recited in claim 23, wherein the step of modulating comprises modifying the announcement in a first language by making the announcement in a first gender voice and filtering the announcement with the low-pass filter, modifying the announcement in a second language by making the announcement in a second gender voice and filtering the announcement with the high-pass filter.

26. The method as recited in claim 25, wherein the step of modulating comprises modifying the announcement in a third language by making the announcement in the second gender voice and filtering the announcement with the low-pass filter.

27. The method as recited in claim 26, wherein the step of modulating comprises modifying the announcement in a fourth language by making the announcement in the first gender voice and filtering the announcement with the high-pass filter.

28. A method of open-field acoustic spatialized communication of announcements in different languages simultaneously to persons moving in a transit vehicle among a plurality of transit stations, comprising: at least two sets of audio communicators, each having at least two non-parametric speakers which are spaced-apart on the interior ceiling and upper portion of the walls of the transit vehicle and each one of the two speakers connected for communication of an electrical signal with a respective one of the two speakers in the other set of audio communicators; means for storing signals representative of at least one announcement in at least two different languages each announcement associated with one of the transit stations; means for simultaneous communication of the signals representative of the announcement associated with one of the stations at which the transit vehicle is next arriving for each one of the at least two languages to a respective connected speakers in the two sets of audio communicators; wherein the announcement, being communicated by connected ones of the speakers in the two audio communicators in one of the at least two languages, is spatializedly discernable by persons in each of the communicated languages, means for modulating the announcement in at least one of the languages to further distinguish the announcement from the announcement in the other languages, wherein means for modulating comprises a low-pass filter for the announcement in the one of the languages.

* * * * *